United States Patent [19]

Dennis

[11] Patent Number: 4,716,975

[45] Date of Patent: Jan. 5, 1988

[54] CUTTING ELEMENT HAVING A STUD AND CUTTING DISK BONDED THERETO

[75] Inventor: Mahlon D. Dennis, Kingwood, Tex.

[73] Assignee: Strata Bit Corporation, Houston, Tex.

[21] Appl. No.: 10,320

[22] Filed: Feb. 3, 1987

[51] Int. Cl.[4] ..... E21B 10/46

[52] U.S. Cl. ..... 175/329; 175/410; 407/118

[58] Field of Search ..... 175/329, 330, 410; 299/91; 407/118, 119

[56] References Cited

U.S. PATENT DOCUMENTS 4,529,048 6/1985 Hall ..... 175/410
4,629,373 12/1986 Hall ..... 175/329 X

FOREIGN PATENT DOCUMENTS 21239 5/1961 German Democratic Rep. ..... 407/118
145973 8/1985 Japan ..... 175/329
795734 1/1981 U.S.S.R. ..... 407/119

*Primary Examiner*—James A. Leppink
*Assistant Examiner*—Hoang C. Dang
*Attorney, Agent, or Firm*—Burns, Doane, Swecker & Mathis

[57] ABSTRACT

A cutting element for use in rotary drill bits comprises a generally cylindrical stud and a cutting disk bonded to a supporting surface of the stud. The supporting surface intersects a cylindrical side surface of the stud to form an edge. The supporting surface includes a plurality of alternating projections and grooves extending in a front-to-rear direction of a supporting surface. The projections and grooves include rear ends terminating short of the edge to minimize the formation of stress cracks in the edge.

10 Claims, 9 Drawing Figures

Fig. 1
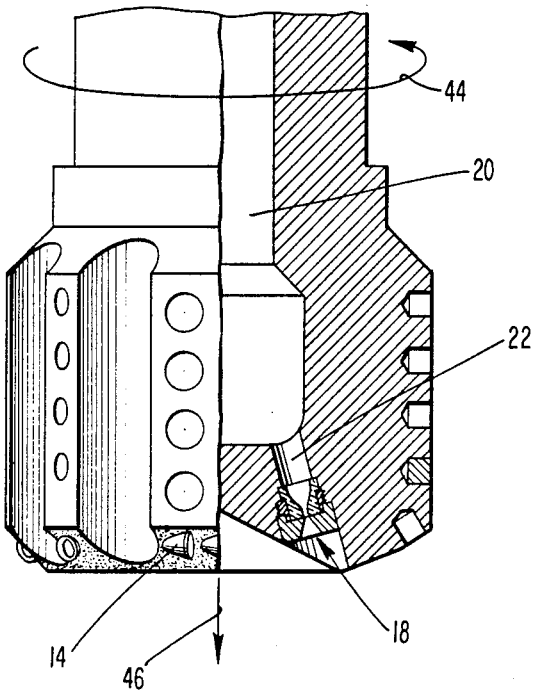
Fig. 2
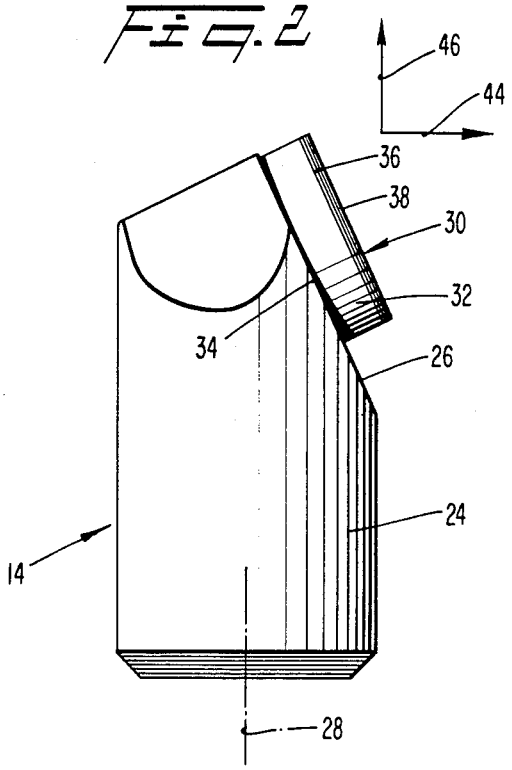
Fig. 3
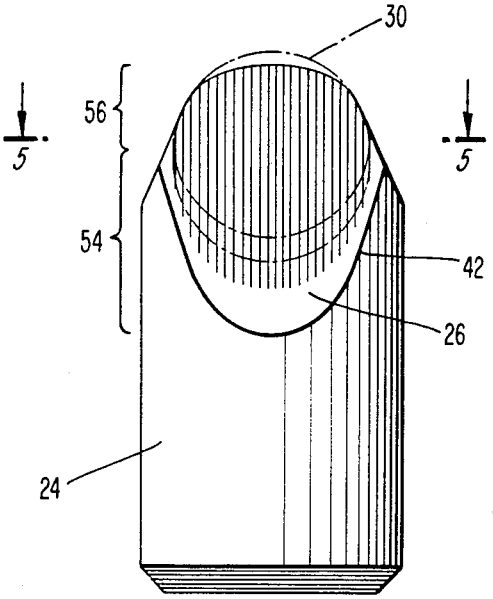
Fig. 4
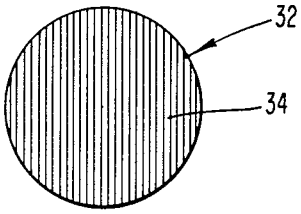
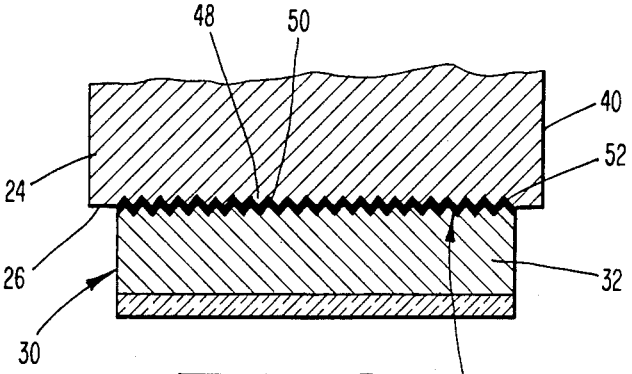
Fig. 5

FIG. 6
PRIOR ART
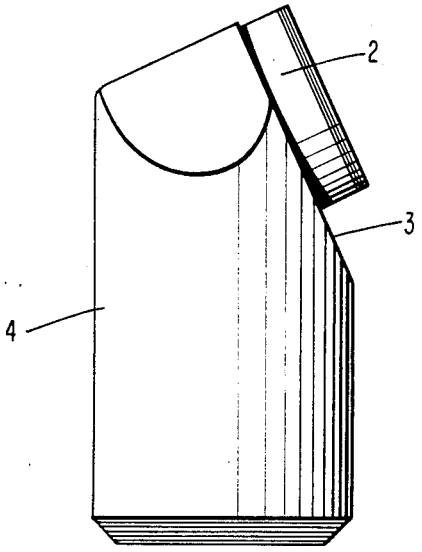
FIG. 7
PRIOR ART
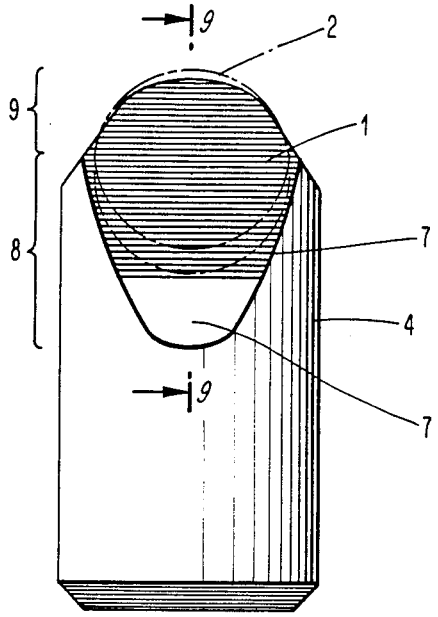
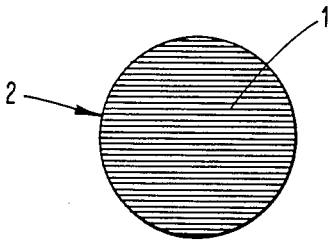
FIG. 8
PRIOR ART
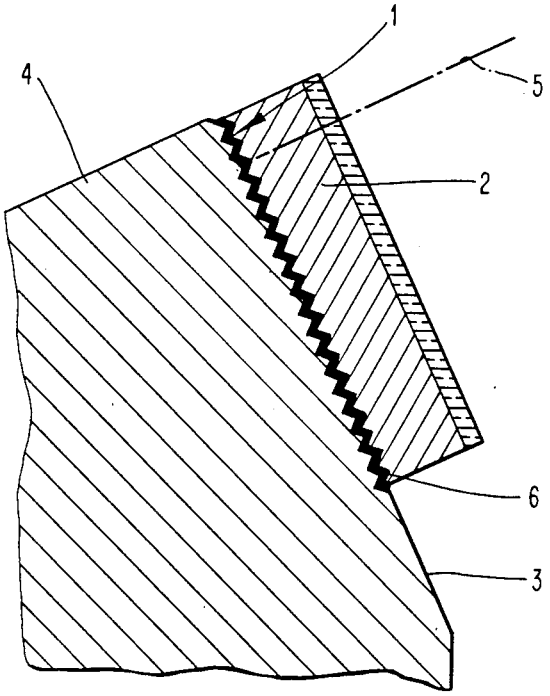
FIG. 9
PRIOR ART

CUTTING ELEMENT HAVING A STUD AND CUTTING DISK BONDED THERETO

BACKGROUND OF THE INVENTION

The present invention relates to diamond cutting elements for use in rotary drill bits which cut bores in subterranean formations.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the borehole. The drilling fluid is delivered to the drill bit downwardly through a passage in the drill stem and is ejected outwardly through nozzles disposed in bores in the cutting face of the drill bit. The ejected drilling fluid is directed outwardly through the nozzles at high speed to aid in cutting, and to flush the cuttings and cool the cutter elements.

Conventional cutting elements comprise a stud having an inclined supporting surface at its front end, and a cutting disk mounted on the supporting surface. The disk comprises a substrate having one surface braze-bonded to the supporting surface and a second surface which carries a diamond substance such as a layer of polycrystalline diamond or thermally stable diamond. The stud and substrate are normally formed of a hard material such as cemented carbide.

As depicted in FIGS. 6–9, it has heretofore been proposed to promote the adherence of the substrate to the stud by providing an arrangement of intermeshing teeth, i.e., V-shaped projections (1) in the substrate (2) and supporting surface (3) of the stud (4). The teeth extend completely across the substrate and supporting surface in a side-to-side direction, i.e., wherein the teeth lie in planes (5) intersecting the longitudinal axis of the stud. A brazing alloy (6) is sandwiched between the teeth of the substrate and supporting surface. In certain respects, the provision of such intermeshing teeth may be considered as improving the connection between the substrate and stud. However, in other respects, such intermeshing teeth create certain disadvantages. For example, the present inventor has observed that in some instances the premature breakage of cutting elements stems from cracks on the stud which initiate from an edge (7) of the stud where the supporting surface intersects the cylindrical side surface. In that regard, cracks have been found to initiate at the irregularities created in the edge (7) by the teeth. In particular, cracks were observed to initiate along that region (8) of the edge situated longitudinally rearwardly of a longitudinal front half (9) of the substrate, as those front and rear directions are considered with reference to the direction of longitudinal advancement of the drill bit. There results, therefore, a tendency for cracks to propagate from that region which weaken the stud and lead to premature breakage thereof.

Consequently, the use of intermeshing projections in the stud and supporting surface has not achieved commercial success.

SUMMARY OF THE INVENTION

The present invention relates to a cutting element for use in rotary drill bits which cut in subterranean formations. The cutting element comprises a generally cylindrical stud having a mounting surface disposed at a front end thereof. A cutting disk includes a first surface bonded to the supporting surface and a second surface carrying a diamond substance. The supporting surface intersects a cylindrical side surface of the stud to form an edge surrounding the supporting surface. The supporting surface includes a plurality of alternating projections and grooves extending in a generally front-to-rear direction of the supporting surface. The projections and grooves include rear ends terminating short of a region of the edge situated longitudinally rearwardly of a longitudinal front half of the substrate. The first surface of the substrate includes a plurality of alternating projections and grooves intermeshing with the grooves and projections of the supporting surface, with a bonding material sandwiched therebetween.

BRIEF DESCRIPTION OF THE DRAWING

The objects and advantages of the invention will become apparent from the following detailed description of a preferred embodiment thereof in connection with the accompanying drawings, in which like numerals designate like elements, and in which:

FIG. 1 is a side elevational view of a drill bit, with a portion thereof broken away, which carries cutting elements according to the present invention;

FIG. 2 is a side elevational view of a cutting element according to the present invention;

FIG. 3 is a front elevational view of the cutting element, with a cutting disk thereof being depicted in phantom;

FIG. 4 is a rear view of a substrate portion of the cutting disk;

FIG. 5 is a cross-sectional view taken along the line 5—5 of FIG. 3;

FIG. 6 is a side elevational view of a prior art cutting element;

FIG. 7 is a front elevational view of the prior art cutting element, with the cutting disk thereof depicted in phantom;

FIG. 8 is a rear view of a substrate portion of the prior art cutting element; and FIG. 9 is a view taken along the line 9—9 in FIG. 7.

DETAILED DESCRIPTION OF A PREFERRED EMBODIMENT OF THE INVENTION

Depicted in FIG. 1 is a rotary drill bit 10. A plurality of small bores are formed in the drill bit body which are adapted to receive cutting elements 14.

A plurality of larger bores are provided in the drill bit for the reception of nozzles 18 for discharging jets of drilling fluid. The drilling fluid is conducted to the nozzles 18 through a passage 20 in the drill bit 10 which communicates with smaller passages 22 in the drill bit. The jet streams aid in the cutting of the formation, cooling of the drill bit cutters, and carrying of the cuttings to the top of the borehole.

Each of the cutting elements 14 comprises a cylindrical stud 24 having a front supporting surface 26 oriented at an acute angle relative to a longitudinal axis 28 of the stud. Mounted on the supporting surface 26 is a cutting disk 30. The cutting disk 30 comprises a substrate 32 having a first surface 34 braze-bonded to the supporting surface 26, and a second surface 36 which carries a diamond substance such as a layer 38 of polycrystalline diamond or thermally stable diamond. The substrate 30 and stud 24 are formed of hard material such as cemented tungsten carbide.

The supporting surface 26 intersects an outer cylindrical surface 40 of the stud to form an edge 42 which constitutes a peripheral edge of the supporting surface 26. The stud 24 is mounted in the drill bit such that the supporting surface faces in a direction having one component in the direction of rotation 44 and another component in the direction of advancement 46 of the drill bit (see FIG. 2).

Formed in the supporting surface 26 is a series of alternating projections 48 and grooves 50 arranged to mesh with corresponding projections and grooves in the first surface 34 of the substrate, with a brazing material 52 sandwiched therebetween. Adjacent projections 48 define the groove 50 disposed therebetween.

The projections and grooves in the supporting surface 26 extend in a front-to-rear direction, i.e., wherein one end of each projection (or groove) is situated longitudinally rearwardly of the opposing end thereof. Importantly, the projections and grooves terminate short of the rear portion of the edge 42.

It will thus be appreciated that the region 54 of the edge 42 situated longitudinally rearwardly of the longitudinal front half 56 of the substrate is not intersected by the projections or grooves (see FIG. 3). Therefore, there exist no irregularities in the region 54 of the edge 42 which would be particularly prone to the initiation of stress fractures.

Preferably, the projections and studs are oriented parallel to each other and lie in planes parallel to the longitudinal axis 28 of the stud.

The above-described orientation of the projections and grooves is different from the prior art arrangement depicted in FIGS. 6–9, wherein the projections 1 extend in a side-to-side direction and intersect the edge at numerous places in the region 8 located rearwardly of the longitudinal front half 9 of the substrate 2.

The length of the projections and grooves in the substrate 32 is not of critical significance in the present invention. That is, it is permissible for those projections and grooves to extend to the outer edge of the substrate. The length of the projections and grooves of the substrate is governed only by the need to assure that proper meshing occurs with the projections and recesses of the supporting surface 26.

It is acceptable for the projections and grooves of the supporting surface 26 to extend forwardly all the way to the edge 42 so as to intersect that edge within the region 56 corresponding to the front longitudinal half of the substrate, although the forward ends of the projections and grooves could terminate short of the edge 42 if desired.

In sum, it has been determined by the present inventor that by terminating the projections and grooves 48, 50 of the supporting surface short of the edge 42 in the above-defined region 54, the initiation of cracks at the edge 42 is resisted to a significantly greater extent than in prior art arrangements such as depicted in FIGS. 6–9. In addition, by orienting the projections in a generally front-to-rear direction, rather than a side-to-side direction, the likelihood of the stud breaking along a line of fracture defined by a groove is virtually eliminated.

The projections and grooves are depicted as being of V-shaped cross-section. However, other configurations such as U-shaped or sinusoidal-shaped, for example, are possible.

The projections can be formed by any suitable process. For example, the projections could be formed simultaneously as the substrate and stud are fabricated, by suitably shaping the mold in which the stud and substrate are sintered. Alternatively, the projections could be formed in a preformed stud by a conventional electrical discharge machine. Typical projections could be 1 mm. deep and 1 mm. in length.

The supporting surface and cutting disk can assume various configurations, such as a chisel-shape. Also, studs shaped other than that depicted can be employed, such as studs in which the supporting surface is oriented perpendicularly to the longitudinal axis of the stud.

If desired, the front-to-rear extending projections and grooves could be oriented at a slight angle with respect to the orientation thereof depicted in FIG. 3. That is, the projections and grooves could be oriented so as to lie in non-vertical planes, while still extending in front-to-rear directions.

Although the present invention has been described in connection with a preferred embodiment thereof, it will be appreciated by those skilled in the art that modifications substitutions, additions and deletions not specifically described may be made, without departing from the spirit and scope of the invention as defined in the appended claims.

What I claim is:

1. A cutting element for use in rotary drill bits which cut in subterranean formations, comprising a generally cylindrical stud having a supporting surface disposed at a front end thereof, and a cutting disk including a substrate having a first surface bonded to said supporting surface and a second surface disposed parallel to said supporting surface and carrying a diamond substance, said supporting surface intersecting a cylindrical side surface of said stud to form an edge surrounding said supporting surface, said supporting surface including a plurality of alternating projections and grooves extending in a generally front-to-rear direction of said supporting surface, said projections and grooves including rear ends terminating short of a region of said edge situated longitudinally rearwardly of a longitudinal front half of said substrate, said first surface of said substrate including a plurality of alternating projections and grooves intermeshing with said grooves and projections of said supporting surface, with a bonding material sandwiched therebetween.

2. A cutting element according to claim 1, wherein said projections and grooves of said supporting surface and said first surface lie in planes disposed parallel to a longitudinal axis of said stud.

3. A cutting element according to claim 1, wherein said supporting surface is oriented at an acute angle relative to a longitudinal axis of said stud.

4. A cutting element according to claim 1, wherein said projections and grooves of said supporting surface extend forwardly all the way to said edge.

5. A cutting element according to claim 1, wherein said projections and grooves are of V-shaped cross-section.

6. A rotary drill bit for cutting in subterranean formations, said drill bit comprising a bit body, and a plurality of cutting elements mounted in said bit body which cut said formation as said bit body is advanced in a fore-aft direction, each said cutting element comprising a generally cylindrical stud having a supporting surface disposed at a front end thereof, and a cutting disk including a substrate having a first surface bonded to said supporting surface and a second surface disposed parallel to said supporting surface and carrying a diamond substance, said supporting surface intersecting a cylindrical side surface of said stud to form an edge surrounding said supporting surface, said supporting surface including a plurality of alternating projections and grooves extending in a generally front-to-rear direction of said supporting surface, said projections and grooves including rear ends terminating short of a region of said edge situated longitudinally rearwardly of a longitudinal front half of said substrate, said first surface of said substrate including a plurality of alternating projections and grooves intermeshing with said grooves and projections of said supporting surface, with a bonding material sandwiched therebetween.

7. A drill bit according to claim 6, wherein said projections and grooves of said supporting surface and said first surface lie in planes disposed parallel to a longitudinal axis of said stud.

8. A drill bit according to claim 6, wherein said supporting surface is oriented at an acute angle relative to a longitudinal axis of said stud.

9. A drill bit according to claim 6, wherein said projections and grooves of said supporting surface extend forwardly all the way to said edge.

10. A drill bit according to claim 6, wherein said projections are of V-shaped cross-section.

* * * * *